US008927073B2

(12) United States Patent
Zhou et al.

(10) Patent No.: US 8,927,073 B2
(45) Date of Patent: Jan. 6, 2015

(54) RECORDING MEDIA

(75) Inventors: Xiaoqi Zhou, San Diego, CA (US); Xulong Fu, San Diego, CA (US); Tao Chen, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 13/990,685

(22) PCT Filed: Dec. 23, 2010

(86) PCT No.: PCT/US2010/062075

§ 371 (c)(1), (2), (4) Date: May 30, 2013

(87) PCT Pub. No.: WO2012/087334

PCT Pub. Date: Jun. 28, 2012

(65) Prior Publication Data

US 2013/0243977 A1 Sep. 19, 2013

(51) Int. Cl.

| | |
|---|---|
| ***B41M 5/00*** | (2006.01) |
| ***B41M 5/50*** | (2006.01) |
| ***B41M 5/52*** | (2006.01) |
| ***G03G 7/00*** | (2006.01) |
| ***G03G 15/00*** | (2006.01) |

(52) U.S. Cl.

CPC ..... *B41M 5/506* (2013.01); *B41M 5/504* (2013.01); *B41M 5/52* (2013.01); *G03G 7/0026* (2013.01); *G03G 7/004* (2013.01); *G03G 7/0046* (2013.01); *G03G 7/0053* (2013.01); *G03G 7/0086* (2013.01); *G03G 15/6591* (2013.01); *B41M 2205/34* (2013.01); *B41M 2205/36* (2013.01); *B41M 2205/38* (2013.01)

USPC ..... 428/32.21; 428/32.22; 428/32.34; 162/137; 162/265

(58) Field of Classification Search

CPC ..... B41M 5/504; B41M 5/506; B41M 5/508; B41M 5/5218; B41M 5/5263; B41M 5/5272; B41M 5/5281; D21H 19/36; D21H 19/82; D21H 19/826; D21H 19/84

USPC ..... 428/32.21, 32.22, 32.34; 162/137, 265

See application file for complete search history.

(56) References Cited

U.S. PATENT DOCUMENTS

| | | | |
|---|---|---|---|
| 4,370,370 | A | 1/1983 | Iwata et al. |
| 4,424,245 | A | 1/1984 | Maruta et al. |

(Continued)

FOREIGN PATENT DOCUMENTS

| | | |
|---|---|---|
| CN | 1863683 | 11/2006 |
| CN | 101856925 | 10/2010 |

(Continued)

OTHER PUBLICATIONS

International Search Report and Written Opinion for PCT/US2010/062075 dated Sep. 28, 2011 (11 pages).

(Continued)

*Primary Examiner* — Betelhem Shewareged

(74) *Attorney, Agent, or Firm* — Hewlett-Packard Patent Department; Sandra B. Beccarelli

(57) ABSTRACT

A recording media containing a raw base wherein said media encompasses, on its image side, a pigmented pre-coating layer and a non-polyolefin barrier coating and, on its backside, a polymeric barrier layer. Also disclosed is a method of making such recording media and methods of forming photographic printed images on said recording media.

16 Claims, 5 Drawing Sheets

(56) References Cited

U.S. PATENT DOCUMENTS

| | | | | |
|---|---|---|---|---|
| 2002/0182376 | A1 | 12/2002 | Mukherjee et al. | |
| 2003/0068475 | A1* | 4/2003 | Ohbayashi et al. | 428/195 |
| 2007/0207278 | A1 | 9/2007 | Mukherjee et al. | |
| 2007/0218254 | A1* | 9/2007 | Zhou et al. | 428/195.1 |
| 2008/0020196 | A1 | 1/2008 | Onishi et al. | |
| 2008/0063817 | A1 | 3/2008 | Tanaka et al. | |
| 2008/0233316 | A1 | 9/2008 | Fu et al. | |
| 2010/0260939 | A1 | 10/2010 | Foley | |

FOREIGN PATENT DOCUMENTS

| | | |
|---|---|---|
| EP | 0770493 | 5/1997 |
| EP | 1228889 | 8/2002 |

OTHER PUBLICATIONS

European Search Report for Application No. PCT/US2010//062075 dated May 9, 2014 (8 pages).

* cited by examiner

RECORDING MEDIA

BACKGROUND

The field of photography has traditionally involved the exposure of a light-sensitive film to an image focused on the film through a lens. This film is made using silver halide, which forms a latent image in response to the exposure. The image is then developed using a chemical process and printed on a specific silver halide photographic paper.

More recently, digital cameras, personal computers and printers have become a viable alternative to such silver halide photography. Today, images are often captured with a digital camera, transferred electronically to a computer with a printer, or directly to a printer, and then produced by the printer in a hardcopy form. Color inkjet printing and/or laser-jet printing are, among other, often used for printing such high quality photographs.

It becomes apparent that the image quality and durability of photographic images, printed using such printing technology, is strongly dependent on the construction of the print media used. Consequently, improved recording media, often specifically designed for producing hardcopy photographs, have been developed for use in such printing devices. These types of print media, which can includes different ink receiving compositions (or layer) and a base substrate, are referred to as photographic printing paper or photo paper substrate.

While many developments have been made regarding such substrates, it has often created challenges to find media which can be effectively used with such printing techniques and which impart good image quality.

BRIEF DESCRIPTION OF THE DRAWING

The drawings illustrate various embodiments of the present system and method and are part of the specification.

DETAILED DESCRIPTION

Figure 1:
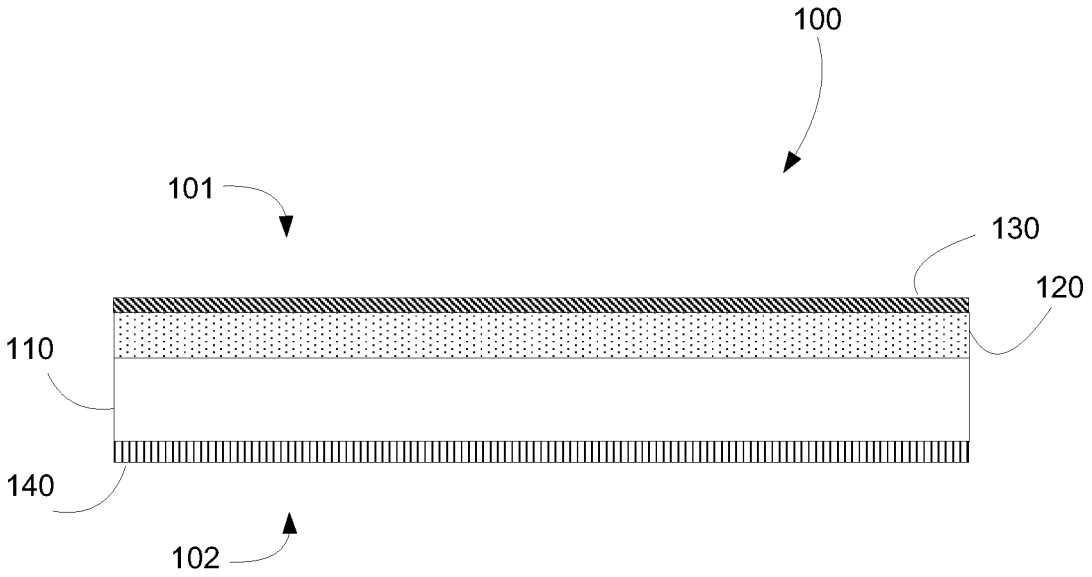
FIG. 1, FIG. 2 and FIG. 3 are cross-sectional views of a recording media according to embodiments of the present disclosure.

Before particular embodiments of the present invention are disclosed and described, it is to be understood that the present disclosure is not limited to the particular process and materials disclosed herein. It is also to be understood that the terminology used herein is used for describing particular embodiments and is not intended to be limiting. In describing and claiming the present disclosure, the following terminology will be used: the singular forms "a", "an", and "the" include plural referents unless the context clearly dictates otherwise. Concentrations, amounts, and other numerical data may be presented herein in a range format. It is to be understood that such range format is used merely for convenience and brevity and should be interpreted flexibly to include not only the numerical values explicitly recited as the limits of the range, but also to include all the individual numerical values or sub-ranges encompassed within that range as if each numerical value and sub-range is explicitly recited. For example, a weight range of approximately 1 wt % to about 20 wt % should be interpreted to include not only the explicitly recited concentration limits of 1 wt % to about 20 wt %, but also to include individual concentrations such as 2 wt %, 3 wt %, 4 wt %, and sub-ranges such as 5 wt % to 15 wt %, 10 wt % to 20 wt %, etc. Wt % means herein percentage by weight. All percents are by weight unless otherwise indicated.

The present disclosure relates to a recording media and to a method for making such recording media. In some embodiments, the recording media encompasses a base substrate that contains, on the image side of the media, a pigmented pre-coating layer and a non-polyolefin barrier coating, and that contains, on the backside of the media, a polymeric barrier layer.

The recording media can be considered, in some examples, as a base stock for printable photographic media or, in some other examples, as a printable media when said recording media encompasses an image-receiving layer.

In some examples, the recording media is a photographic recording media. In other terms, the print media of the present disclosure can be used as a photographic recording media and has thus the properties and the appearance, at least, equal to the properties and the appearance of silver halide photo media substrates. The recording media described herein has, indeed, a good surface smoothness and has a high gloss appearance. The media can be used as an image-receiving media that shows excellent image quality. In addition, the recording media has a structure which is receptive and which presents excellent absorption and adherence properties to the ink deposed thereon. Furthermore, the recording media presents excellent curl control across different environmental conditions.

In some examples, the recording media can be used as a photographic printing paper and can encompass an image-receiving layer. Such media is able to provide advantages such as low cost, glossy appearance, surface smoothness and excellent image quality when used to produce photographic printouts. Furthermore, the recording media shows excellent image quality while not having ink absorption issues such as ink bleeding, ink coalescence, and bonding, curling of the paper's edges issues or cockling of the paper's surface.

The recording media described herein provides an excellent photo feel. As used herein, the term "photo feel" mean herein that that such an image, printed in a printing process, feels like a photographic silver halide material when touched.

As used herein, "images" refers to marks, signs, symbols, figures, indications, and/or appearances deposited upon a material or substrate with either visible or an invisible ink composition. Examples of an image can include characters, words, numbers, alphanumeric symbols, punctuation, text, lines, underlines, highlights, and the like.

Figure 2:
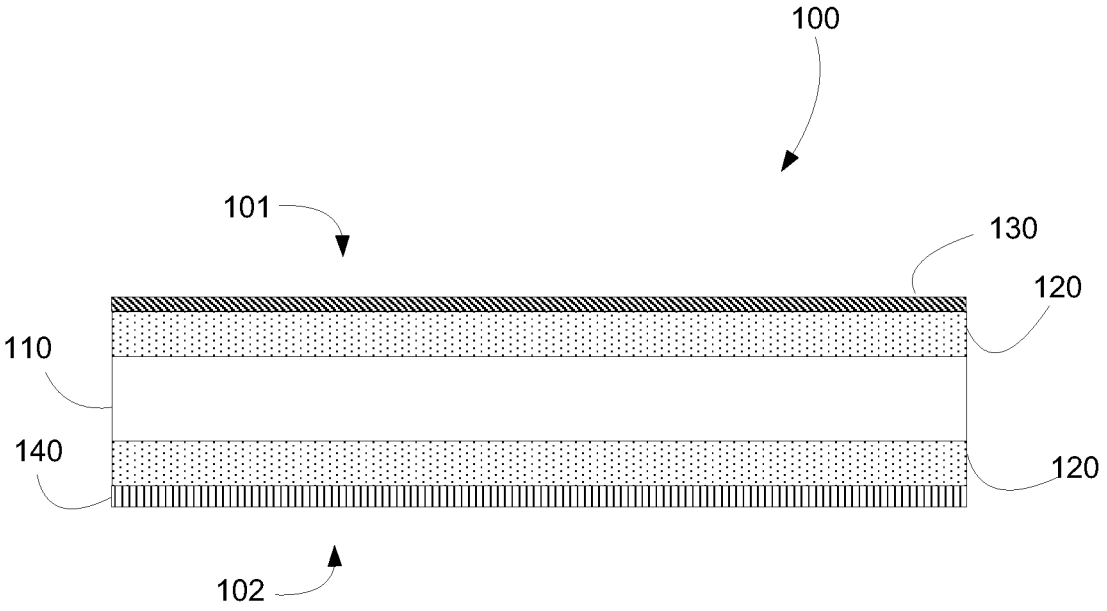
Figure 3:
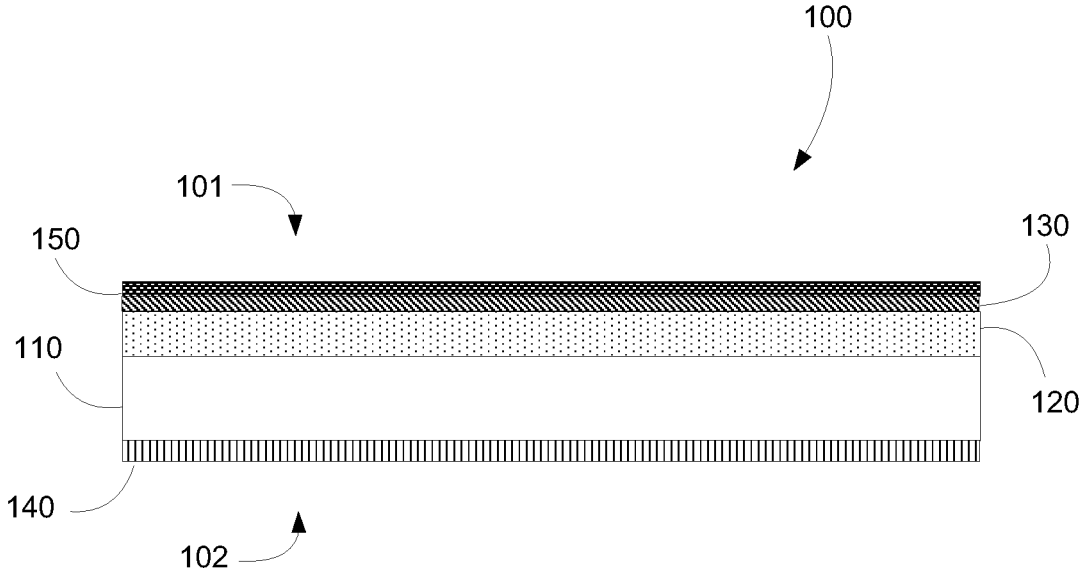

FIG. 1, FIG. 2 and FIG. 3 illustrate some embodiments of the recording media (100). As will be appreciated by those skilled in the art, FIG. 1, FIG. 2 and FIG. 3 illustrate the relative positioning of the various layers of the recording media (100) without illustrating the relative thicknesses of the various layers.

In some examples, as shown in FIG. 1, the recording media is a base stock for printable media. The recording media includes a raw base (110) which may be, for example, a cellulose raw base. Such recording media (100), including the raw base (110), presents a backside (102) and an image side (101) where the image is printed thereon. In some examples, the image side (101) encompasses a pigmented pre-coating layer (120) that is applied over the raw base (110) and a non-polyolefin barrier coating (130) applied over the pigmented pre-coating layer (120). The barrier layer (130) is, for example, formed using a non-polyolefin resin and provides the base stock for the printable media (100) with high gloss, smoothness, water-resistance and some breathability. As illustrated in FIG. 1, a polymeric barrier layer (140) is applied over the raw base (110), on the backside (102) of said raw base (110).

In some examples, the recording media is a media well adapted for liquid electrophotographic printing device (i.e. using liquid electrophotographic toner such as, for example, the printing devices developed by Indigo BV). The recording media (100) can be a photographic recording media for liquid electro-photographic printing (LEP), and can be used in a method of forming photographic printed images, said method including applying a liquid electrophotographic ink (liquid toner) directly on the non-polyolefin barrier coating (130) of the photographic recording media (100).

In some examples, as shown in FIG. 2, the recording media is a base stock for printable media. The recording media includes a raw base (110) that presents a backside (102) and an image side (101). The image side encompasses a pigmented pre-coating layer (120) that is applied over the raw base (110), and a non-polyolefin barrier coating (130) applied over the pigmented pre-coating layer (120). As illustrated in FIG. 2, the backside encompasses a pigmented pre-coating layer (120) applied onto the raw base and a polymeric barrier layer (140) applied over said pigmented pre-coating layer (120). Thus, as shown in FIG. 2, the pigmented pre-coating layer (120) is provided on both sides of the raw base (110).

FIG. 3 illustrates some other embodiments of the recording media. As illustrated herein, the recording media is a printable media. Said printable media includes a raw base (110) wherein the image side (101) encompasses a pigmented pre-coating layer (120) applied over the raw base (110), a non-polyolefin barrier coating (130) applied over the pigmented pre-coating layer (120) and an image-receiving layer (150). The backside (102) encompasses a polymeric barrier layer (140) that is applied onto the raw base (110). Such image coating layer (150) can be an inkjet image-receiving layer, a laser-jet image-receiving layer or a LEP (liquid electro-photographic printing) image-receiving layer.

In some examples, the printable media (100) is a printable media that contains an image side (101), i.e. wherein the printable image is deposited, and a backside (102) which is not adapted to receive the printable image. Without being limited by any theory, it is believed that the backside (102) of the substrate, that encompasses the polymeric barrier layer (140), might serve to compensate for the presence of the barrier layer (130) and of the pigmented pre-coating layer (120) on the other side of the raw base (110) (image side).

In some examples, the recording media, that encompasses an inkjet image-receiving layer (150) over the non-polyolefin barrier coating (130), is an inkjet photographic printing media or media well adapted for inkjet printing device. The recording media (100) can be thus an inkjet photo paper and can be used in a method of forming photographic printed images, said method including applying an inkjet composition, via inkjet printing technique, directly on the inkjet image-receiving layer (150) of the printing media.

In some other examples, the recording media, that encompasses a laser-jet image-receiving layer (150) over the non-polyolefin barrier coating (130), is a laser-jet photographic printing media or media well adapted for laser printing device. Said recording media can be thus a laser-jet photo paper and can be used in a method of forming photographic printed images, said method including applying solid toner, via laser-jet printing technique, directly on the laser-jet image-receiving layer (150) of the photographic printing media.

In yet some other examples, the recording media that encompasses an liquid electrophotographic printing (LEP) image-receiving layer (150) over the non-polyolefin barrier coating (130), is a LEP photographic printing media or media well adapted for LEP printing device. Said printable media (100) can be thus an LEP paper and can be used in a method of forming photographic printed images, said method including applying liquid toner, via electrophotographic printing technique, directly on the liquid toner printing image-receiving layer (150) of the printing media.

In some embodiments, the raw base (110) is a cellulose base paper. Any kind of cellulose raw base may be used. The raw base (110) can be made of any suitable wood or non-wood pulp. Non-limitative examples of suitable pulps include any kind of chemical pulp, mechanical wood pulp, chemically treated ground pulp, CTMP (chemical thermo mechanical pulp), and/or mixtures thereof. In some examples, the raw base (110) contains non-wood pulp such as pulp originating from bamboo, bagasse, kenaf, papyrus, etc. . . . . Bleached hardwood chemical pulps may make up the main pulp composition. This pulp has shorter fiber structure than soft wood, which contribute to good formation of the finished paper. Fillers may also be incorporated into the pulp, for example, to substantially control physical properties of the final coated paper. The filler particles fill in the void spaces of the fiber network and result in a denser, smoother, brighter and opaque sheet. Examples of the fillers include, but are not limited to, ground calcium carbonate, precipitated calcium carbonate, titanium dioxide, kaolin clay, silicates, plastic pigment, alumina trihydrate, and/or mixtures thereof. It is to be understood that any desirable amount of filler, such as 15 wt %, may be used. In some examples, the amount of filler ranges from about 0.1 wt % to about 20 wt % of the raw base, and in some other examples, the amount of filler ranges from about 5 wt % to about 15 wt % of the raw base. When preparing the paper base stock, internal and surface sizing may be used. This process may improve internal bond strength of the substrate fibers, and may control the resistance of the coated substrate to wetting, penetration, and absorption of aqueous liquids. Internal sizing may be accomplished by adding a sizing agent to the raw base in the wet end. Non-limitative examples of suitable sizing agents include rosin-based sizing agent(s), wax-based sizing agent(s), cellulose-reactive sizing agent(s) and other synthetic sizing agent(s), and/or mixtures. It is to be understood that the type and amount of surface sizing agent(s) may substantially improve moisture resistance and may alter the stiffness of the base paper stock. Surface sizing (i.e. apply sizing agent to the formatted paper roll) may be accomplished by film size press, pond size press and other surface techniques. Included in this wet end processing can be additional functional additives such as but not limited to dispersants, biocides, retention aids, defoamers, dyes, anionic trash, and optical brighteners.

In some examples, the raw base has a base weight of about 100 to about 300 grams/meter$^2$ (gsm), and, in some other examples, has a base weight of about 150 to about 220 gsm.

In some examples, since the stiffness of the raw base may be related, at least in part, to the paper thickness, or paper weight, it is to be understood that with substantially the same pulp and filler composition, the thinner the paper caliper is, the lower the paper stiffness will be. If base weight is less than 100 gsm, low flexural rigidity may generate a higher jam rate. Customers also have lower acceptance for such a lightweight paper as photographic printout. However, if base weight is over 300 gsm, many printers cannot support such high stiffness media.

In some examples, the stiffness of the raw base ranges from about 800 Gurley stiffness units to about 2000 Gurley stiffness units in the paper machine direction, and ranges from about 400 Gurley stiffness units and about 1200 Gurley stiffness units in the paper cross machine direction. In some other examples, the base paper stiffness ranges from about 800 Gurley stiffness units to about 1500 Gurley stiffness units in the paper machine direction, and from about 600 Gurley stiffness units to about 1000 Gurley stiffness units in the paper cross machine direction. A method, such as TAPPI T543 om-94, using a Gurley-type stiffness tester, may be used to determine the stiffness of the paper stock. Without being linked by any theory, it is believed that the surface smoothness of the base stock paper is an important factor in the quality of the paper and photographic images printed thereon. In some examples, a photographic printing base stock with high smoothness and glossiness can be made at effectively low cost, as long as the pigmented sub layer sheets have a minimum smoothness and glossiness level. In some examples, the surface smoothness, after pigmented pre-coating layers (120) being coated, ranges from about 2.5 to about 5.0 Sheffield units, as measured by a Hagerty smoothness tester, Model 538.

In some examples, the recording media (100) encompasses a pigmented pre-coating layer (120). Such as illustrated in FIGS. 1 and 3, the pigmented pre-coating layer (120) can be present on one side of the raw base (110), i.e. on the image side (101) of the raw base or, in some other examples, such as illustrated in FIG. 2, the pigmented pre-coating layer (120) can be present on the backside (102) and on the image side (101) of the recording media (100), i.e. on both side of the raw base (110).

Without being linked by any theory, it is believed that the function of the pigmented pre-coating layer (120) is to create a smooth surface to help develop superior gloss. Additionally, the pigmented pre-coating layer (120) can promote improved opacity, brightness, and appropriate color hue for the print medium.

The pigmented pre-coating layer (120) can contain at least one inorganic pigment and at least one polymeric binder. The pigmented pre-coating layer (120) may also include any of the variety of coating additives known to improve the appearance or functionality of photographic printing paper. Such additives can be, for examples, mordants, biocides, optical brightener, surfactants, plasticizers and cross-linking agents. In some examples, the inorganic pigment may be prepared in powder or slurry form before being mixed with the binder for coating on the substrate. Examples of the inorganic pigments include, but are not limited to, titanium dioxide, hydrated alumina, calcium carbonate, barium sulfate, silica, high brightness alumina silicates, boehmite, pseudoboehmite, zinc oxide, kaolin clays, and/or their combination.

In some examples, the particle size of inorganic pigments ranges from about 0.2 to about 1.5 micrometer and, in some other examples, ranges from about 0.5 to about 1.0 micrometer. Co-pigments may be used in conjunction with inorganic pigments to promote the sheet's opacity, smoothness, and glossiness. The co-pigments may be synthetic organic polymers such as hollow sphere emulsions, porous hollow plastic pigments, and solid spherical plastic pigments. The synthetic organic polymers may have a uniform particle size ranging from about 0.2 to about 1.0 micrometer, and the amount used in the formulations may range from about 1 part by dry weight to about 10 parts by weight organic polymer to about 100 parts by dry weight of inorganic pigments. In some other examples, the amount of synthetic organic polymers, used in the formulations, may range from about 3 parts to about 5 parts per 100 parts of inorganic pigments. Without being linked by any theory, it is believed that the function of the binder is to supply an adhesion force between the raw base (110) and the pigment particles, as well as binding pigment particles to each other. The binder may be selected from the group of water-soluble binders and water dispersible polymers that exhibit high binding power for base paper stock and pigments, either alone or as a combination. Suitable binders include, but are not limited to, water soluble polymers such as polyvinyl alcohol, starch derivatives, gelatin, cellulose derivatives, acrylamide polymers, and water dispersible polymers such as acrylic polymers or copolymers, vinyl acetate latex, polyesters, vinylidene chloride latex, styrene-butadiene or acrylonitrile-butadiene copolymers. Such binders can be polyvinylalcohol or copolymer of vinylpyrrolidone. The copolymer of vinylpyrrolidone can include various other copolymerized monomers, such as methyl acrylates, methyl methacrylate, ethyl acrylate, hydroxyethyl acrylate, hydroxyethyl methacrylate, ethylene, vinylacetates, vinylimidazole, vinylpyridine, vinylcaprolactams, methyl vinylether, maleic anhydride, vinylamides, vinylchloride, vinylidene chloride, dimethylaminoethyl methacrylate, acrylamide, methacrylamide, acrylonitrile, styrene, acrylic acid, sodium vinylsulfonate, vinylpropionate, and methyl vinylketone, etc. In some examples, the copolymer of vinylpyrrolidone can be a copolymer of vinylpyrrolidone and vinylacetate or vinylcaprolactam or polyvinylalcohol. The polyvinylalcohol or copolymer of vinylpyrrolidone can have a weight average molecular weight ranging from about 10,000 Mw to about 1,000,000 Mw or can have a weight average molecular weight ranging from about 20,000 Mw to about 500,000 Mw. In some examples, the binder is a polyvinylalcohol having a molecular length in the range of 20,000 to 500,000.

In some examples, the inorganic pigment and binder may be used in the following proportions or effective amounts: from 5 to 15 parts by dry weight of binder to 100 parts by dry weight of inorganic pigments. In some other examples, 8 to 10 parts binder are used relative to the 100 parts of pigment.

In some other examples, the solids content of the coating compositions can range from 60 to 75 percent by weight (wt %) with a viscosity of 1000 to 1500 centipoise (cps) as measured by a low shear Brookfield viscometer at a speed of 100 revolutions per minute (rpm), or 30 cps to 40 cps at a higher shear rate of 4500 rpm using a high shear Hercules viscometer.

In some examples, the pigmented pre-coating layer (120) can be applied over the raw base (110) with a coating weight of about 5 to about 30 grams/meter$^2$ (gsm) or with a coat weight ranging from about 10 to about 15 gsm. When applied to both side of the raw base (110), the coat weight of the pigmented pre-coatings layer (120) is from about 10 to about 15 gsm for each coating layer.

In some embodiments, the image side (101) of the recording media (100) according to the present disclosure encompasses a barrier coating (130) that is located above the pigmented pre-coating layer (120). Such barrier coating (130) is a non-polyolefin barrier coating (130). In some examples, the barrier coating (130) of the printable media (100) has a coat weight ranging from about 1 to about 30 grams/m$^2$; in some other examples, ranging from about 2 to about 15 grams/m$^2$ and, in yet some other examples, ranging from about 3 to about 6 grams/m$^2$.

In some examples, the non-polyolefin barrier coating (130) can be considered as the image-receiving layer in some of the printing application, such as when using liquid electrophotographic ink (liquid toner) devices such as, for example, Indigo BV devices. In some other examples, such as inkjet and laser-jet printing, the non-polyolefin barrier coating (130) can act as a gloss enhancer layer where inkjet or laser-jet image-receiving coating (150) is applied on.

In some examples, by non-polyolefin barrier coating, it is meant herein a layer formed by aqueous polymer dispersion (such as for example latex emulsion) which is capable, upon the evaporation of dispersion water, to form a polymeric film having particle aggregation.

In some examples, the non-polyolefin barrier coating (130) of the printable media (100) can be formed using any non-polyolefin polymeric materials which have good film-forming properties and produce a non-absorbing layer with smooth high-gloss appearance. Examples of non-polyolefin polymeric materials include, but are not limited to, water-soluble polymers, water dispersible polymers, and/or combinations thereof. Some other examples include, but are not limited to, acrylic resins, polyester resins, polycarbonate resins, polyacetal resins, polyvinyl acetate resins, polyether resin, polyurethane resins, and polyepoxide resins. In some embodiments, the barrier coating (130) contains polyurethane resins, acrylic resins and/or polyester resins.

The polyurethane resin can includes all kinds of water dispersible linear or cyclic polyurethanes and polyisocyanates. Acrylic resins may include polyacrylic acids and their ester, polymethyacrylic acids and their ester, and the copolymer of polyacrylonitrileacrylates. Some examples of these polymers are polymethyl acrylate, polyethyl acrylate, polybutyl acrylate, polyhexyl acrylate, poly-n-octyl acrylate, poly-2-ethylhexyl acrylate, polybenzyl acrylate, polynonyl acrylate, polylauryl acrylate, polymethyl methacrylate, polyethyl methacrylate, polybutyl methacrylate, polyhexyl methacrylate, poly-n-octyl methacrylate, poly-2-ethylhexyl methacrylate, polybenzyl methacrylate, polynonyl methacrylate, polylauryl methacrylate, and acrylonitrile acrylates-styrene copolymers. Examples of polyester resins include the condensation polymer of the following acids with different alcohols: phthalic acids, azelaic acids, maleic acids, succinic acids fumaric acids, citraconic acids, itaconic acids, glutaconic acids, adipic acids, terephthalic acids, iso-phthalic acids, malonic acids, n-dodecenylsuccinic acids, iso-dodecenylsuccinic acids, n-dodecylsuccinic acids, iso-dodecylsuccinic acids, n-octenylsuccinic acids, iso-octenylsuccinic acids, n-octylsuccinic acids, iso-octylsuccinic acids, and anhydrides of these acids.

In some examples, the glass transition temperatures of the non-polyolefin barrier coating (130) are maintained in the range of about 10 to about 90° C., and, in some other examples, in the range of about 30 to about 60° C. The non-polyolefin barrier coating (130) can contain some pigments to promote image responses such as whiteness, brightness, and sharpness. Example of such pigments include, but are in no way limited to, ground calcium carbonate, precipitated calcium carbonate, zinc oxide, titanium dioxide, barium sulfate, magnesium carbonate, and kaolin clay. Titanium dioxide can be used in an amount representing from about 8 to about 15% by weight of polymeric resins in barrier layer. The titanium dioxide may be either rutile or anatase, or a combination of the two to promote both whiteness and image sharpness. The non-polyolefin barrier coating (130) may further include optional additives such as mordants, biocides, optical brightener, surfactants, plasticizers and cross-linking agents.

In some example, the film made with "non-polyolefin" polymer does not include film structure having continuous film formed by molecular entanglement (such as extrusion in the melted states, or films formed by water/solvent soluble polymeric resins). In some other example, the film forming temperature (FFT) of the non-polyolefin barrier coating is below than room temperature (i.e. below than about 30° C.).

Without being linked by any theory, it is considered that any method that engages a process at elevated temperature such as, but not limited to extrusion, film blowing, film casting, thermal melting, is not suitable for making such non-polyolefin barrier coating (130). Indeed, such techniques not only cause high operation cost but also alter the media structure since these heated method tends to create a continuous polymeric film that will inevitably reduce "breathability" of the raw base.

In some examples, the backside (102) of the printable media (100) encompasses a polymeric barrier coating (140). Such polymeric barrier coating (140) can be a polyolefin barrier coating. Such polymeric barrier coating (140) can be applied by a film extrusion at elevated temperature. Such polymeric barrier coating (140) can be located above the pigmented pre-coating layer (120) or directly on the raw base (110). Without being linked by any theory, it is believed that the polymeric barrier layer (140) on the backside (102) tends to balances internal stress in the raw base (110) so that curling of the substrate is minimized.

As used herein, the term polyolefin refers to a polymer produced by olefin homo-polymerization or copolymerization reaction via either high-pressure polymerization or low pressure in the presence of special catalyst like Ziegler and metallocene catalysts, where olefin refers to a hydrocarbon compounds containing a carbon-carbon double bond alkene with general formula $C_nH_{2n}$.

In some examples, polymeric barrier coating contain polyolefin resins. Examples of polyolefin resins include, but are not limited to, high density polyethylene (HDPE), low density polyethylene (LDPE), polypropylene (PP), polymethylpentene (PMP), and copolymers of ethylene with hexane, butane, and octane (linear low density polyethylene, LLDPE). The polyolefin resins can also be blends of these polymeric materials, such as HDPE/LDPE, LDPE/LLDPE, PP/LDPE, and PP/LLDPE. The polyolefin material can thus be selected from the group consisting of polyethylene (PE), polypropylene (PP), polymethylpentene, polybutylene polymer and mixtures thereof. In some other examples, the polyolefin material is polyethylene, polypropylene or ethylene vinyl acetate polymer.

The polyolefin material can also be a polyolefin copolymer. Examples of polyolefin copolymer include copolymer of polyethylene, propylene and ethylene such as hexene, butene and octene. In some examples, the modified polyolefin materials can be used, where modified polyolefin refers to small amount of functional co-monomer repeat units with no more than 10% by weight were polymerized on the macromolecule chains to modify chemical and physical properties of the polyolefin materials. Examples of modified polyolefin material include but not limited to, acrylic grafted polyolefin such as polypropylene, polyethylene copolymer of vinyl acetate, ethyl methyl acrylate, ethylene ethyl acrylate, ethyl acrylic acid, ethyl glycidyl methacrylate, ethyl-n-butyl acrylate and mixtures thereof. In some examples, modified polyolefin material is a maleic anhydride and acrylic acid modified polyolefin such as modified polypropylene and modified polyethylene and mixtures thereof.

In some examples, polyolefin barrier coating is a biaxially oriented; in some other examples, polyolefin barrier coating is a biaxially oriented polyethylene or polypropylene. In some examples, the thickness of the biaxially oriented sheet is from 10 to 175 microns. Below 15 microns, the sheets cannot be thick enough to minimize any inherent non-planarity in the support and would be more difficult to manufacture. At thicknesses higher than 70 microns, little improvement in either surface smoothness or mechanical properties is seen, and so there is little justification for the further increase in cost for extra materials.

In addition, it may be desirable to use various additives such as antioxidants, slip agents, or lubricants, and light stabilizers in the polymeric material as well as biocides in the paper elements. These additives are added to improve, among other things, the dispersibility of fillers and/or colorants, as well as the thermal and color stability during processing and the manufacturability and the longevity of the finished article. For example, the polyolefin coating can contain antioxidants such as 4,4'-butylidene-bis(6-tert-butyl-meta-cresol), di-lauryl-3,3'-thiopropionate, N-butylated-p-aminophenol, 2,6-di-tert-butyl-p-cresol, 2,2-di-tert-butyl-4-methyl-phenol, N,N-disalicylidene-1,2-diaminopropane, tetra(2,4-tert-butylphenyl)-4,4'-diphenyl diphosphonite, octadecyl 3-(3',5'-di-tert-butyl-4'-hydroxyphenyl propionate), or combinations of the above, heat stabilizers, such as higher aliphatic acid metal salts such as magnesium stearate, calcium stearate, zinc stearate, aluminum stearate, calcium palmitate, zirconium octylate, sodium laurate, and salts of benzoic acid such as sodium benzoate, calcium benzoate, magnesium benzoate and zinc benzoate, light stabilizers such as hindered amine light stabilizers (HALS), of which an example is poly {[6-[(1,1,3,3-tetramethylbutylamino}-1,3,5-triazine-4-piperidinyl)-imino]-1,6-hexanediyl[{2,2,6,6-tetramethyl-4-piperidinyl)imino]} (Chimassorb 944 LD/FL).

Without being linked by any theory, it is believed that the coat weight of polymeric barrier layer (140) on the backside (102) of the printed media is designed to count-balance the "pre-stress" generated by the coating layers in the image-receiving side containing the pigmented pre-coating layer (120), the non-polyolefin barrier coating (130) and the ink receiving coating (150) if applied. When the polymeric barrier layer (140) is applied on the backside (102), the coat weight can be adapted to the weight of the layers present on the image side, so that the final product is curl balanced in all the conditions. In some examples, the higher the thickness of the image side coating layers is, the thinker the polymeric barrier layer is.

In some examples, such as illustrate in FIG. 3, the recording media is a printable media (100) that encompasses an image-receiving layer (150). Such image-receiving layer (150) can be applied over the non-polyolefin barrier coating (130) on the image-side (101) of the recording media (100).

Without being limited by any theory, it is believed that the image-receiving layer (150) is specifically formulated to interact with the ink, perhaps being tailored to specific ink compositions, to improve the quality of the printed image. Various compositions for such an image-receiving layer are known generally in the art or will be apparent to those of skill in the art given a particular ink composition and the principles described herein.

In some examples, the coating weight of the image-receiving layer (150) is ranging from about 5 to about 30 grams/meter$^2$ (gsm), in some other examples, is ranging from about 10 to about 35 grams/meter$^2$ (gsm).

Such image-receiving layer (150) can be an inkjet image-receiving layer, a laser-jet image-receiving layer or a liquid electrophotographic printing (LEP) image-receiving layer. By inkjet image-receiving layer, it is meant herein that the image-receiving layer (150) is adapted to receive image printed using inkjet technique. Non-limitative examples of inkjet printing technique include thermal, acoustic, continuous and piezoelectric inkjet printing. In some examples, the printable media mentioned herein is well adapted to be used with inkjet ink composition. By laser-jet image-receiving layer, it is meant herein that the image-receiving layer (150) is adapted to receive image printed using laser-jet technique, such as printing device using dry toner. The laser-jet image-receiving layer can also be called dry toner recovering layer for electrophotographic printing. Such laser-jet techniques include, for examples, laser printing and electrophotographic printing technique using dry toner. By liquid electrophotographic printing (LEP) image-receiving layer, it is meant herein that the image-receiving layer (150) is adapted to receive image printed using LEP technique, such as printing device using liquid toner manufactured by Hewlett-Packard Company's Indigo press.

In some examples, the image-receiving layer (150) is an inkjet image-receiving layer that includes inorganic fine particles, a polymeric binder and other functional additives such as ink fixatives. The inorganic fine particles can be any kind of inorganic pigments. In some examples, such inorganic pigments are white inorganic pigments. In some other examples, such inorganic pigments have a plurality of pores structure to provide a high degree of absorption capacity for liquid ink vehicle via capillary action and the others alike. Inorganic pigment can be selected from the group consisting of silica, clay, kaolin, calcium carbonate, talc, titanium dioxide and zeolites. Inorganic pigment can be inorganic oxide colloidal particles such as colloidal silica, aluminum oxides (boehmites), and mixture of them. In some examples, the inorganic colloidal particles are colloidal silica particles. As such, the colloidal silica can be a stable dispersion of amorphous silica particles. Examples of inorganic pigment used in the image-receiving layer (150) includes, but in no way limited to, Cartacoat® K (available from Clariant Chemical); Snowtex® ST-O, ST-OL, ST-20L, and ST-C (available from Nissan Chemical); Ludox® CL, AM and TMA (available from Grace-Davison Chemical); Nyacol® AL20, Nyacol® AL20, Nyacol® A1530, Nyacol® Ce02, Nyacol® SN15, Nyacol® DP5370, and NYACOL® Zr50/20 (available from Nyacol Nano Technologies). The polymeric binder present in the image-receiving layer (150) can be any kind of water-soluble or water dispersible polymers such as polyvinyl alcohol, polyvinylpyrrolidone, methyl cellulose, hydroxypropylmethyl cellulose, gelatin, polyethylene oxide, acryl-based polymer, polyester, polyurethane and/or quaternary ammonium type copolymer.

In some other examples, the image-receiving layer (150) is a laser-jet image-receiving layer. The laser-jet image-receiving layer can include inorganic pigments, polymeric hollow particle pigments, binders and/or a charge control additive. Suitable inorganic pigments may be provided in a powder or slurry form. Examples of suitable inorganic pigments include, but are not limited to, titanium dioxide, hydrated alumina, calcium carbonate, barium sulfate, silica, clays (such as high brightness kaolin clays) and zinc oxide. By way of example only, one suitable inorganic pigment that has desirable properties is calcium carbonate. The calcium carbonate may be ground calcium carbonate (GCC) or may be a chemical precipitated calcium carbonate (PCC). Binders can be present in the laser-jet image-receiving layer. Suitable binders include water-soluble polymers such as polyvinyl alcohol, starch derivatives, gelatin, cellulose derivatives, acrylamide polymers, or water dispersible polymers such as acrylic polymers or copolymers, vinyl acetate latex, polyesters, vinylidene chloride latex, and styrene-butadiene or acrylonitrile-butadiene copolymer latex. Plastic hollow pigments are water dispersed, polymeric hollow spherical particles filled with water. The plastic hollow pigments are non-film forming in ambient conditions and remain as discrete particles during coating. Hollow particulates like the plastic hollow pigments can have a void volume that is between 20% and 70% of its total volume of material. The particulate plastic hollow pigments can have a particulate size from about 0.3

μm to about 2 μm and/or a glass transition temperature (TG) from about 50° C. to about 120° C. Examples of suitable plastic hollow pigments that can be used in accordance with embodiments of the present invention include Ropaque BC-643, Ropaque HP-543, or Ropaque OP-84, all manufactured by Rohm and Haas Company, Philadelphia, Pa., USA and HS-3000NA, which is available from The Dow Chemical Company, Midland, Mich., USA. In some examples, the laser-jet image-receiving layer may contain either calcium carbonate, grounded calcium carbonate (GCC) or precipitated calcium carbonate (PCC). The GCC is sold under the trade name of Hydrocarb HG or Covercarb HP from Omya Inc. PCC can be Opacarb® A40 available from Specialty Minerals Inc. The laser-jet image-receiving layer may contain synthetic polymer such as, for example, an acrylic-styrene emulsion polymer such as Acrona® S728 available from BASF, Inc. The laser-jet image-receiving layer may also contain water soluble metallic salts such as sodium chloride or calcium carbonate from Aldrich Inc and a slip aid such as, for example, Michem® Emulsion 29235 available from Michelman Inc. In some examples, the laser-jet image-receiving layer may also contain optical brightness agent such as Leucopher® LS (from Clariant Inc), and other coating aids such as PH control, biocides, color dye and surfactant.

In yet some other examples, the image-receiving layer (150) is a liquid electrophotographic printing (LEP) image-receiving layer. In some examples, the LEP image-receiving layer may contain either calcium carbonate, grounded calcium carbonate (GCC) or precipitated calcium carbonate (PCC). The GCC is sold under the trade name of Hydrocarb HG or Covercarb HP from Omya Inc. PCC can be Opacarb® A40 available from Specialty Minerals Inc. The LEP image-receiving layer may contain a synthetic polymer such as, for example, an acrylic emulsion polymer sold under the trade name RAYCRYL® 30S available from Specialty Polymers, Inc. The LEP image-receiving layer may contain synthetic polymer such as, for example, an acrylic emulsion polymer such as Acrona® S728 available from BASF, Inc. The LEP image-receiving layer may contain slip aid such as, for example, Michem® Emulsion 29235 available from Michelman Inc.

In some embodiments, the printable media (100), according to the present disclosure, is produced by, first, applying a pigmented pre-coating layer (120) on the raw base (110) on the image side (101) of the media; drying and calendering said pigmented pre-coating layer (120); coating the non-polyolefin barrier coating (130) over said pigmented pre-coating layer (120); and extruding the polymeric barrier (140) on the raw base, on the backside of the media.

In some other embodiments, the printable media (100) is produced by applying a pigmented pre-coating layer (120) on the raw base, on the image side (101) and on the backside (102) of the media; drying and calendering said pigmented pre-coating layers (120) on both sides of the media; coating the non-polyolefin barrier coating (130) over said pigmented pre-coating layer (120) on the image side (101) and then extruding the polymeric barrier (140) on the backside of the media (110), over the pre-coating layer (120).

In yet some other embodiments, the method of fabricating the printable media (100) further encompasses the step of applying an image-receiving layer (150) on said non-polyolefin barrier coating (130). Such image-receiving layer (150) can be an inkjet image-receiving layer, a laser-jet image-receiving layer or a liquid electrophotographic printing (LEP) image-receiving layer. The printable media (100) can then be produced by, first, applying a pigmented pre-coating layer (120) on the image side (101) and, eventually, on the backside (102) of the media; drying and calendering said pigmented pre-coating layers (120) on both sides of the raw base (110); coating the non-polyolefin barrier coating (130) over said pigmented pre-coating layer (120) on the image side (101), applying an image-receiving layer (150) on said non-polyolefin barrier coating (130) and then extruding the polymeric barrier (140) on the backside of the media.

Figure 4:
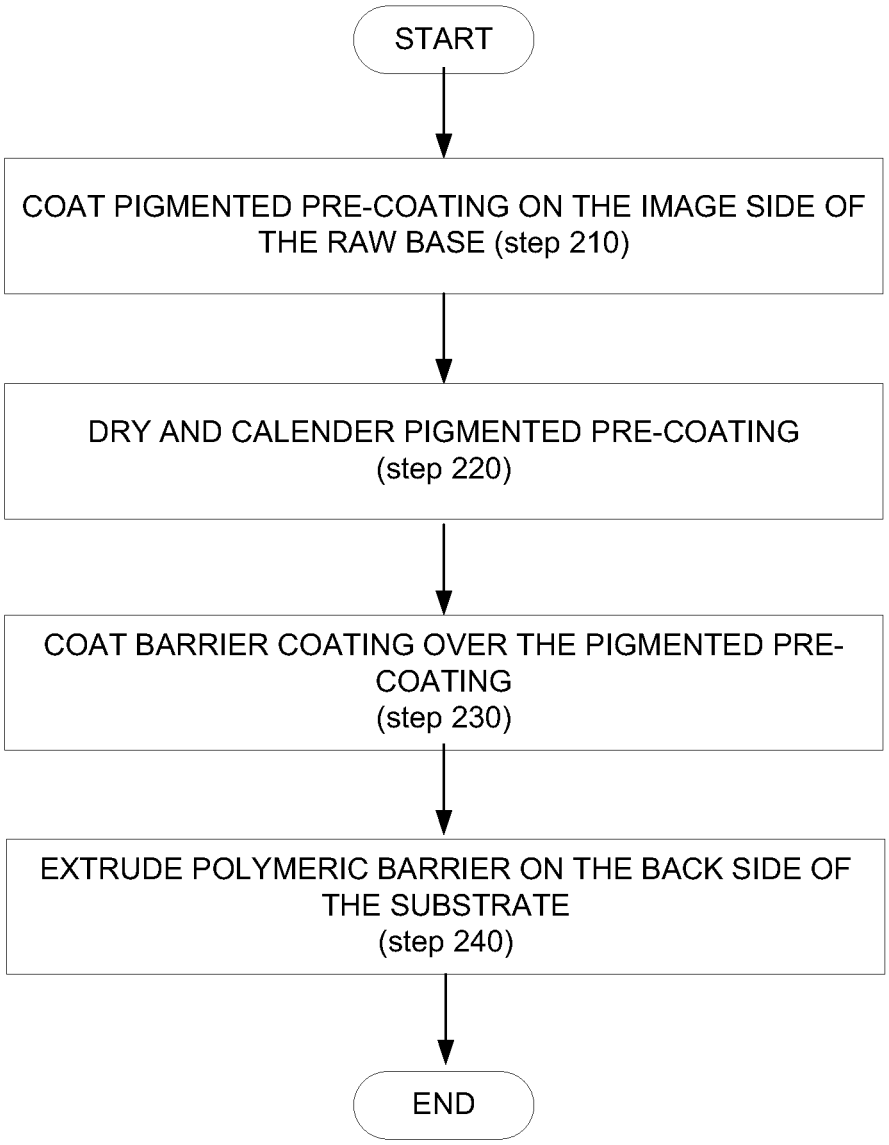
FIG. 4, FIG. 5 and FIG. 6 are flowcharts illustrating methods of making recording a media according to embodiments of the present disclosure.
Figure 5:
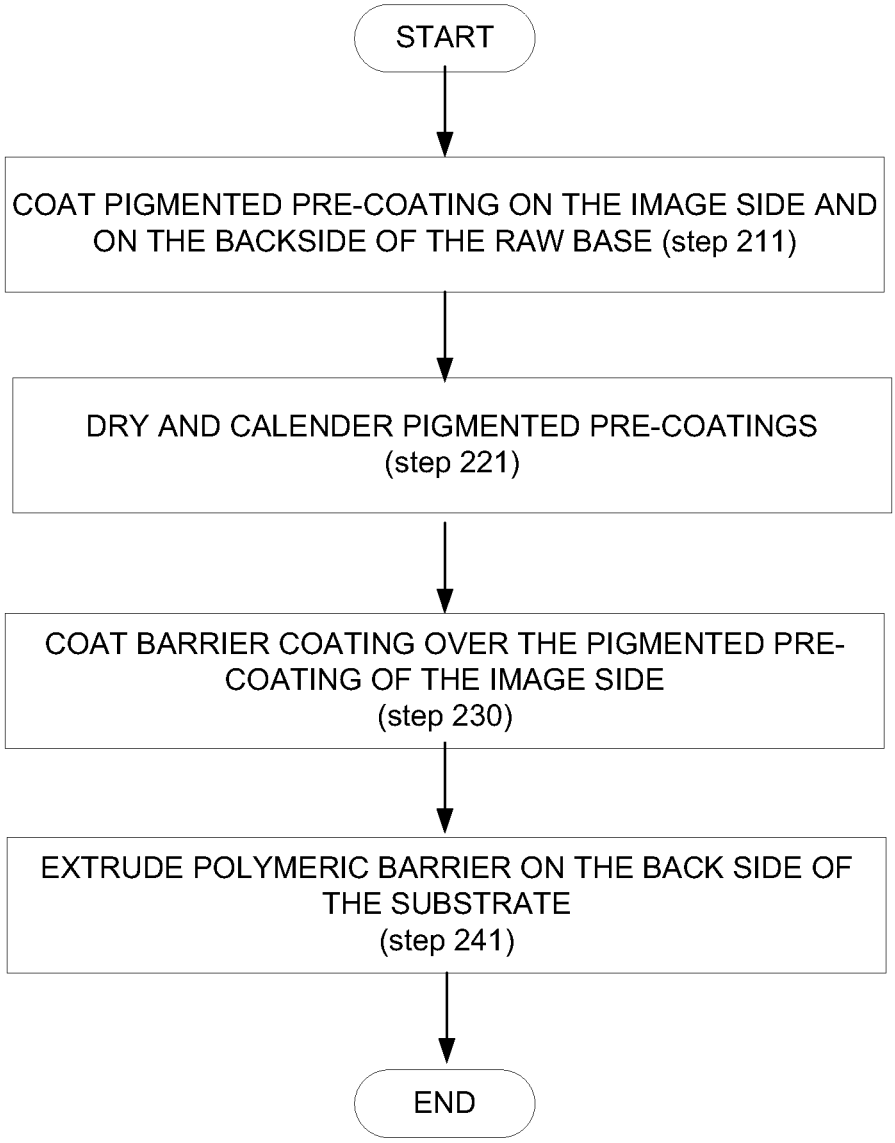
Figure 6:
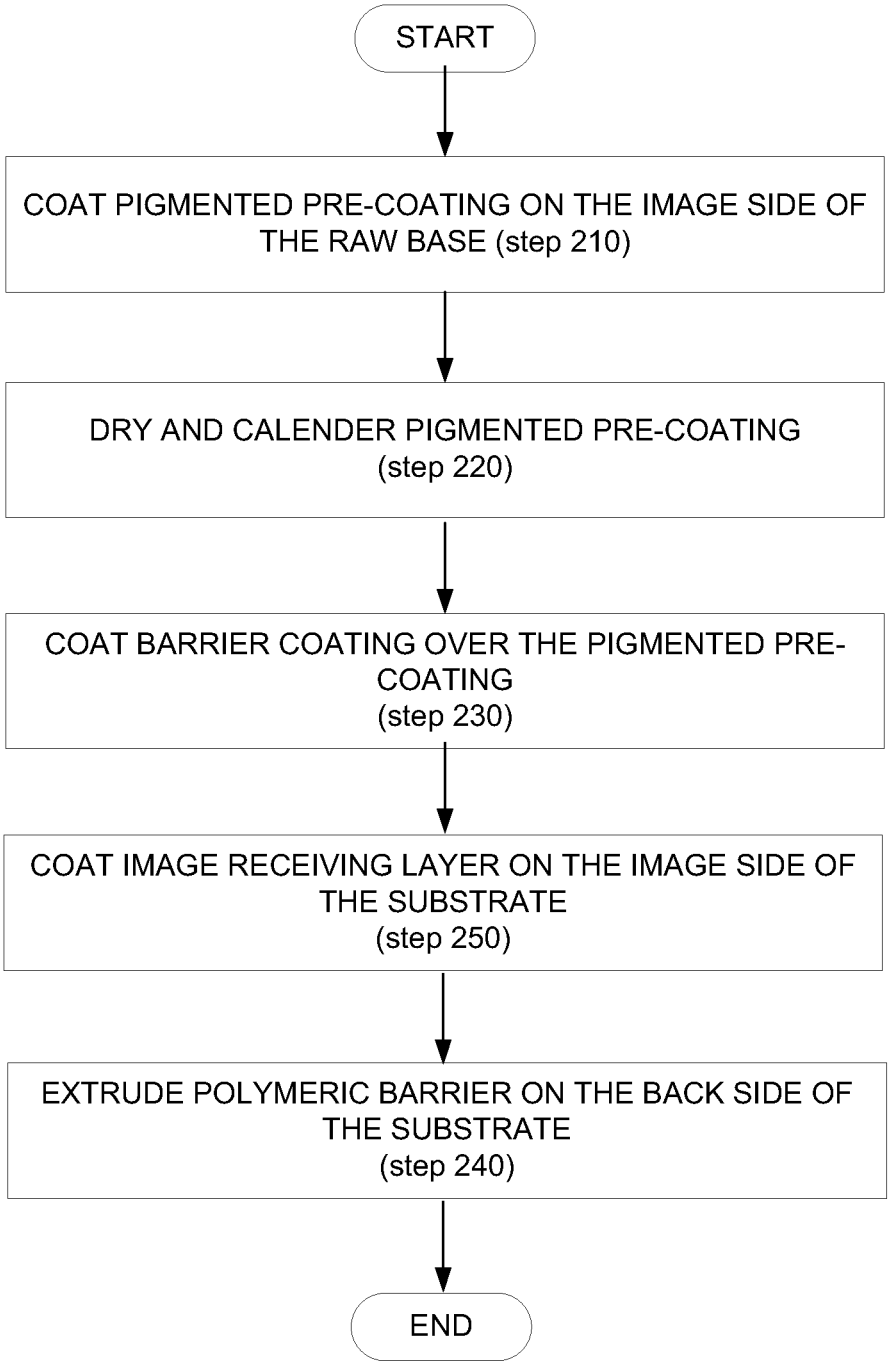

FIG. 4, FIG. 5 and FIG. 6 are flowcharts illustrating methods of making the recording media such as described herein.

In some examples, such as illustrated in FIG. 4, (step 210), the pigmented pre-coating layer (120) is applied only on the image side (101) of the raw base (110). In some other examples, such as illustrated in FIG. 5 (step 211), the pigmented pre-coating layer (120) is applied onto the image side (101) and onto the backside of the raw base (110). The pigmented pre-coating layers (120), that can be applied only to the image side (101) or to both on the image side (101) and on the backside (102) of the raw base (110), are then dried and calendered (steps 220 and 221).

Drying of the pigmented pre-coating layers (120) can be performed by any suitable means, including, but not limited to, convection, conduction, infrared radiation, atmospheric exposure, or other known method. A calendering process can then be used to achieve the desired gloss or surface smoothness (step 220 and 221). In paper manufacturing, calendering is the process of smoothing the surface of the paper by pressing it between rollers. Super-calendering is calendering in a calender unit in which nips are formed between a smooth-surface press roll, such as a metal roll, and a roll covered with a resilient cover, such as a polymer roll. The resilient-surface roll adapts itself to the contours of the surface of paper and presses the opposite side of paper evenly against the smooth-surface press roll. Any of a number of calendering devices and methods can be used. The calendering device can be a separate super-calendering machine, an on-line calendering unit, an off-line soft nip calendering machine, or the like. Some calendering systems do not need the paper to be as completely dried as other forms of calendering. In some examples, the calendering is carried out at a temperature ranging from about 50 to about 150° C. (metal roll surface temperature) and, in some other examples, at about 80 to about 110° C. In some examples, the nip pressure can be any value between about 100 to about 500 KN/cm2.

Such as illustrated in FIGS. 4, 5 and 6, (step 230), a polymeric barrier coating (130) is applied onto the pigmented pre-coating layer (120) on the image side (101) of the raw base (110). The coating methods used to form said polymeric barrier layer (130), as well as the pigmented pre-coating layer (120) may include, but are not limited to blade coating processes, rod coating processes, air-knife coating processes, curtain coating processes, slot coating processes, jet coating processing or any combination thereof.

Such as illustrated in FIGS. 4 and 6 (step 240) and in FIG. 5 (step 241), the polymeric barrier layer (140) is formed by an extrusion process and is applied over the backside of the raw base. Such polymeric barrier layer (140) can be applied directly on the raw base (step 240) or can be applied over the pigmented pre-coating layer (120) (step 241). The backside polymeric barrier (140) is applied by extruding polymeric materials into a desired sheet thickness. In some examples, the backside polymeric barrier (140) is a polyolefin barrier.

The backside polymeric barrier (140) can be made according to various extrusion operations like extrusion coating, lamination, hot melt extrusion or modification of cast extrusion or coating operation. In some examples, backside polyolefin barrier (140) is formed by a co-extrusion process. The backside polymeric barrier (140) can also be made by hot melt extrusion technique. As used herein, the terms extrude and hot melt extrusion refer to process wherein the material is heated to a temperature at, or above, its melting point and deposited on a moving substrate at a uniform thickness. The extrusion process may be practiced within a wide range of extrusion temperatures, for example, from about 120° C. to about 350° C., and speeds, for example, from 60 m/min to 460 m/min, depending on the particular intended application of the material. In some examples, the extrusion temperature ranges from about 150° C. to about 290° C. In such extrusion processes, the polymer mixture of the backside polymeric barrier (140) is first subjected to heat and pressure inside the barrel of an extruder. The molten polymer is then forced through the narrow slit of an extrusion-coating die by an extruder screw. At the exit of the die slit, a molten curtain emerges. In some examples, this molten curtain is drawn down from the die into a nip between two counter-rotating rolls, a chill roll and pressure roll. In some other examples, while coming into contact with a faster moving substrate in the nip formed between the chill roll and the pressure roller, a hot film is drawn out to the desired thickness, forming a layer with a specific thickness onto the substrate.

In some examples, such as illustrated in FIG. 6, (step 250), an image-receiving layer (150) is applied on the recording media (100) over non-polyolefin barrier coating (130). The image-receiving layer (150) is formed over the barrier layer (130) on the image side (101) of recording media. The application of said image-receiving layer (150), (step 250), can be performed after the application of the barrier layer (130) and before the extrusion of the polymeric barrier (140). The image-receiving layer can be coated using any suitable coating machines such as slot die, curtain, rod, blade, roll, gravure coaters. In some examples, the image-receiving layer can be coated with metering size press on the paper machine in line.

The recording media (100) obtained with the method illustrated in FIGS. 4 and 5 can be considered and used as a base stock for printable photographic media. The recording media (100) obtained with the method illustrated in FIG. 6, i.e. including an image-receiving layer, can be considered and used as a printable photographic media. The recording media (100) obtained with the method described above presents very high gloss appearance, high surface smoothness, true photo paper feel and excellent curl control across environment conditions at low cost.

In some embodiments, the present disclosure refers to a method of forming photographic printed images on recording media including a raw base (110), a pigmented pre-coating layer (120) and a non-polyolefin barrier coating (130) applied over the pigmented pre-coating layer on its image side (101) and a polymeric barrier layer (140) on its backside (102); wherein the method encompasses applying a liquid electrophotographic ink (liquid toner or liquid ElectroInk) via electrophotographic printing method, onto said media to form the desired printed image.

In some other embodiments, the present disclosure refers to a method of forming photographic printed images on recording media including a raw base (110), a pigmented pre-coating layer (120), a non-polyolefin barrier coating (130) and an inkjet image-receiving layer (150), applied over the non-polyolefin barrier coating, on its image side (101) and a polymeric barrier layer (140) on the backside (102) of the media; wherein the method encompasses projecting a stream of droplets of inkjet ink composition, via inkjet printing technique, onto said media to form the desired printed image. Non-limitative examples of such inkjet printing technique include thermal, acoustic, continuous and piezoelectric inkjet printing. By inkjet composition, it is meant herein that the composition is very well adapted to be used in an inkjet device and/or in an inkjet printing process.

In some yet other embodiments, the present disclosure refers to a method of forming photographic printed images on recording media including a raw base (110), a pigmented pre-coating layer (120), a non-polyolefin barrier coating (130) and a laser-jet image-receiving layer (150), applied over the non-polyolefin barrier coating, on its image side (101) and a polymeric barrier layer (140) on the backside (102) of the media; wherein the method encompasses projecting a stream of droplets of inkjet ink composition, via inkjet printing technique, onto said media to form the desired printed image.

In some yet other embodiments, the present disclosure refers to a method of forming photographic printed images on recording media including a raw base (110), a pigmented pre-coating layer (120), a non-polyolefin barrier coating (130) and a liquid electrophotographic printing (LEP) image-receiving layer, applied over the non-polyolefin barrier coating, on its image side (101) and a polymeric barrier layer (140) on the backside (102) of the media; wherein the method encompasses applying a liquid electrophotographic ink (liquid toner or liquid ElectroInk) via electrophotographic printing method, onto said media to form the desired printed image.

The printed images, resulting from such printing techniques, are photo printed image and present high image quality, a good surface smoothness and has a very high gloss appearance.

The preceding description has been presented to illustrate and describe embodiments of the present invention. Although certain example methods, compositions, apparatus and articles of manufacture have been described herein, the scope of coverage of this patent is not limited thereto. On the contrary, this patent covers all methods, apparatus and articles of manufacture fairly falling within the scope of the claims either literally or under the doctrine of equivalents.

Example 1

Recording media according to the present disclosure and comparative media are prepared. Media A, B and C are photographic base stock media; Media D and E are printable photographic media.

Media A contains a raw base (110), a pigmented pre-coating layer (120) applied on both side of said raw base, a non-polyolefin barrier coating (130) applied over the pigmented pre-coating on the image side and a polymeric barrier layer (140) applied over the pigmented pre-coating layer on the backside of the recording media. The raw base is made with base paper stock prepared with cellulose fibers. Such base paper stock contains between about 85 and about 88 wt % of chemical pulped fiber and between about 12 and about 15 wt % of calcium carbonate fillers. The base paper stock is internal and surface sized in view of improving the water resistance. Pigmented pre-coating layers (120) are applied on the both sides of base paper stock with a coat weight of about 15 gsm, by blade coating processes. Such pigmented pre-coating layers encompass about 83 wt % of calcium carbonate fillers and about 15 wt % of polymeric acrylic latex binder (about 2 wt % of additives are used in the base coating including surfactant, deformer, PH adjuster biocide and other processing control chemicals). On the image side of the recording media, over the pigmented pre-coating layer (120), a non-polyolefin barrier coating (130) is applied with a coat weight of about 2 to about 3 gsm. Such layer encompasses about 99 wt % of polymeric latex and about 1 wt % of surfactant. On the backside of the recording media, over the pigmented pre-coating layer, a polymeric barrier layer (140) is applied by extrusion method with a coat weight of about 10 gsm.

Comparative media B is made. Such comparative media B contains a raw base paper substrate, a pigmented pre-coating layer (120) that is applied on both side of the base paper and a non-polyolefin barrier coating (130). The raw base, the pigmented pre-coating layer (120) and the non-polyolefin barrier coating (130) are formulated as described in the media A, and are applied with the same construction and using the same techniques. However, the polymeric barrier layer (140) is absent.

Comparative media C is made. Such comparative media contains the raw base paper substrate as described in the media A and, on top of the raw base paper substrate, polymeric barrier layers (140) are applied, by extrusion method, on both side of the raw base (110) with a coat weight of about 25 gsm.

Recording media D, E and F are made as described for the media A, however, they both contains on top of the non-polyolefin barrier coating, an image-receiving layer (150) that is well adapted for inkjet printing technique (in Example D), that is well adapted for laser-jet printing technique (in Example E) or that is well adapted for LEP printing technique (in Example F). The inkjet image-receiving layer is coated with a coat weight of about 22 gsm. The laser-jet image-receiving layer is coated with a coat weight of about 12 gsm. The LEP image-receiving layer is coated with a coat weight of about 5 gsm.

The formula of the different coatings, used for making the photo media A, B, C, D, E and F are illustrated in the table (a) below:

TABLE (a)

| | |
|---|---|
| **Base paper** | |
| Chemical pulped fiber | 88.0% |
| calcium carbonate | 12.0% |
| **Pre-coating layer** | |
| Hydrocarb HG | 83.0 wt % |
| DL 930 | 15.0 wt % |
| Additives (Pluronic ® L61; Foamaster ®; Sodium Hydroxide) | 2.0 wt % |
| **Non-polyolefin layer** | |
| Lucidin ® 614 | 99.0 wt % |
| Silwet ® L-7600 | 1.0 wt % |
| **Polymeric barrier layer** | |
| HDPE | 60.0 wt % |
| LDPE | 40.0 wt % |
| **Inkjet image-receiving layer** | |
| Mowiol ® 40-88 | 14.9 wt % |
| Cartafix ® LA | 1.7 wt % |
| Organosilane ® DS 1189 | 5.8 wt % |
| Silwet ® L-7600 | 0.4 wt % |
| Cabosil ® M55 | 75.4 wt % |
| Boric Acid | 1.8 wt % |
| **Laser-jet image-receiving layer** | |
| Hydrocarb HG | 76.0 wt % |
| Acronal ® S728 | 16.2 wt % |
| sodium chloride | 2.3 wt % |
| Leucopher ® LS | 5.5 wt % |
| **LEP image-receiving layer** | |
| Opacarb ® A40 | 53.8 wt % |
| Raycryl ® 30s | 40.3 wt % |

TABLE (a)-continued

| | |
|---|---|
| Acronal ® S728 | 5.4 wt % |
| Michem ® emulsion 29235 | 0.5 wt % |

Mowiol®40-88 is available from Kuraray Specialties Europe GmbH. Organosilane® DS 1189 is available from Degussa. Cartafix® LA is available from Clariant. Silwet® L-7600 is available from GE Silicones Inc. Cabosil® M55 silica is available from Cabot Corp. Boric Acid is available from Aldrich. Opacarb® A40 is precipitated calcium carbonate, available from Specialty Minerals Inc. Raycryl® 30S is an acrylic emulsion polymer available from Specialty Polymers Inc. Acronal® S 728 is a styrene/n-butyl acrylate copolymer (water dispersible binder) available from Baden Aniline and Soda Factory (BASF). Michem® Emulsion 29235 is a slip aid available from Michelman. Lucidin® 614 is available from Rohm and Haas Inc. Hydrocarb HG is Grounded Calcium Carbonate available from Omya Inc. Leucopher® LS is an optical brightness agent available from Clariant. Pluronic® L61 is available from BASF. Foamaster® is available from Cognis Ltd. Sodium Hydroxide is available from Aldrich Ltd. DL 930 is available from Dow Chemicals.

The structures and compositions of media A, B, C, D, E and F are illustrated in the table (b) below. The table also summarizes the different coat weight of the different layers, when present, in gram/square meter (gsm).

TABLE (b)

| | media A | media B comp. | media C comp. | media D | media E | media F |
|---|---|---|---|---|---|---|
| Base Paper | yes | yes | yes | yes | yes | yes |
| Image side: | | | | | | |
| pre-coating layer | 15 gsm | 15 gsm | — | 15 gsm | 15 gsm | 15 gsm |
| non-polyolefin layer | 3 gsm | 3 gsm | — | 3 gsm | 3 gsm | 3 gsm |
| image-receiving layer | | | | 22 gsm | 12 gsm | 5 gsm |
| polymeric barrier | — | — | 25 gsm | — | — | |
| Backside: | | | | | | |
| pre-coating layer | 15 gsm | 15 gsm | — | 15 gsm | 15 gsm | 15 gsm |
| polymeric barrier layer | 10 gsm | — | 25 gsm | 10 gsm | 10 gsm | 10 gsm |

Example 2

Media A, B and C, illustrated in table (b), are evaluated for different criteria: for the curling effect at different temperatures and humidity conditions; for their surface smoothness and gloss; and for the photo feeling and Coefficient of Friction (COF).

The curling effect is evaluated by preparing, at least three sheets of the different sample A, B and C (either in 4"×6" or use A size sheet). The samples are then acclimate on wire rack in various environment conditions champers such as 23° C. at 50% Relative Humidity (RH); 32° C. at 20% RH; 15° C. at 80% RH; 15° C. at 20% RH; 30° C. at 80% RH for 24 hours. The samples are then measured: the four curling edges are measured using ruler. Such measures are reported in mm ("+" defines curls forming towards the image layer side and "−" defines curls forming away from the image layer side). The average of the curl is then calculated for each condition. It should be note that, for photobase paper, to counter balance stress generated by image-receiving layer coating, negative curl (often called as pre-stressed base) is desired. The absence of curling or a small curling effect is obtained when measures are close to zero. An absence of curling effect is desired.

The Surface smoothness is measured with a Hagerty smoothness tester (Per Tappi method of T-538 om-96). This method is a measurement of the airflow between the specimen (backed by flat glass on the bottom side) and two pressurized, concentric annular lands that are impressed into the sample from the top side. The rate of airflow is related to the surface roughness of paper. The higher the number is, the rougher the surfaces. The unit is SU (Sheffield smoothness unit).

The surface gloss of each media sample is measured using a Micro Tri-Gloss Meter (available from BYK Gardner Inc.) according to the standard procedures described in the instrument manual provided by the manufacturer. The surface gloss are measured on 8.5'*11' non-imaged (i.e., non-printed) sheets. The Micro-Tri Gloss Meter is calibrated at twenty (20°) degrees using the standard supplied by the unit. The sample was placed on a flat surface and the surface gloss was measured at twenty (20°) degrees. Measurements are made on three sample sheets, and the average value is reported in terms of gloss units (GU).

The Coefficient of Friction (COF) is evaluated using the TMI slips and friction tester (model #32-90) per the TAPPI T-549 om-01 method. The COF should be in the range of about 0.3 to about 0.5 in order to provide similar photo feel as silver halide photo.

The "Photo-feeling" is evaluated visually and corresponds to the ability of the media to look likes a photographic silver halide material, specifically when touched. The grade of photo-feel is attributed with 5 being the best, 1 being the worst.

The results are illustrated in the table (c) below. This result illustrates that the recording media A according to the present invention provide, in the same time, a good curling effect, good smoothness and gloss performances, excellent photo feeling and good COF.

TABLE (c)

| Curling at different temperature/humidity condition (in mm) | | | |
|---|---|---|---|
| | 23° C. at 50% | 15° C. at 80% | 32° C. at 20% |
| media A | −2 | −12 | 9 |
| media B | 1 | 33 | −19 |
| media C | −20 | −34 | −9 |

| Surface smoothness and gloss | | |
|---|---|---|
| | Smoothness (PPS) | 20° gloss |
| media A | 0.69 | 44 |
| media B | 0.69 | 41 |
| media C | 0.55 | 48 |

| Photo-feeling and COF | | |
|---|---|---|
| | Photo feel | COF (Static, Front to back) |
| media A | 5 | 0.45 |
| media B | 3 | 0.65 |
| media C | 5 | 0.45 |

The invention claimed is:

1. A recording media, comprising:

a raw base;

an image side of the recording media having a pigmented pre-coating layer and a non-polyolefin barrier coating on the raw base; and a backside of the recording media having a polymeric barrier layer on the raw base, wherein the polymeric barrier layer is an extruded polyolefin film selected from the group consisting of polyethylene, polypropylene, polymethylpentene, polybutylene, and mixtures thereof;

wherein the polymeric barrier layer is biaxially oriented.

2. The recording media according to claim 1 wherein said media is a base stock for printable photographic media.

3. The recording media according to claim 1, further comprising a second pigmented pre-coating layer present on the backside of said recording media between the raw base and the polymeric barrier layer.

4. The recording media according to claim 1 wherein the pigmented pre-coating layer contains one inorganic pigment and at least one polymeric binder.

5. The recording media according to claim 1 wherein the non-polyolefin barrier coating contains polyurethane resins, acrylic resins and/or polyester resins.

6. The recording media according to claim 1 wherein said media is a printable media including an inkjet image receiving layer that is applied over the non-polyolefin barrier coating, on the image-side of said media.

7. The recording media according to claim 1 wherein said media is a printable media including a laser-jet image receiving layer that is applied over the non-polyolefin barrier coating, on the image-side of said printable media.

8. The recording media according to claim 6 wherein said media is a printable media including a liquid electrophotographic printing (LEP) image receiving layer that is applied over the non-polyolefin barrier coating, on the image-side of said printable media.

9. A method of making a recording media, comprising:

a. applying a pigmented pre-coating layer on a raw base, on an image side of the media, b. drying and calendering the pigmented pre-coating layer, c. coating a non-polyolefin barrier coating over said pigmented pre-coating layer, and d. extruding a polymeric barrier layer on the raw base, on a backside of the media, thereby forming an extruded polyolefin film selected from the group consisting of polyethylene, polypropylene, polymethylpentene, polybutylene, and mixtures thereof;

wherein the polymeric barrier layer is biaxially oriented.

10. The method of making a recording media according to claim 9 wherein the pigmented pre-coating layer is applied, onto the raw base, on the image side and on the backside of the media.

11. The method of making a recording media according to claim 9 wherein an image-receiving layer is coated over the non-polyolefin barrier coating.

12. A method of forming photographic printed images on a recording media including a raw base, a pigmented pre-coating layer and a non-polyolefin barrier coating on the raw base, on an image side of the media, and a polymeric barrier layer on the raw base, on a backside of the media, wherein the polymeric barrier layer is a biaxially oriented extruded polyolefin film selected from the group consisting of polyethylene, polypropylene, polymethylpentene, polybutylene, and mixtures thereof; wherein the method encompasses applying a liquid electrophotographic ink via electrophotographic printing method, onto said media to form the desired printed image.

13. A method of forming photographic printed images on a recording media including a raw base, a pigmented pre-coating layer, a non-polyolefin barrier coating and an inkjet image-receiving layer on the raw base, on an image side of the media, and a polymeric barrier layer on the raw base, on a backside of the media, wherein the polymeric barrier layer is a biaxially oriented extruded polyolefin film selected from the group consisting of polyethylene, polypropylene, polymethylpentene, polybutylene, and mixtures thereof; wherein the method encompasses projecting a stream of droplets of inkjet ink composition, via inkjet printing technique, onto said media to form the desired printed image.

14. A method of forming photographic printed images on a recording media including a raw base, a pigmented pre-coating layer, a non-polyolefin barrier coating and a laser-jet image-receiving layer on the raw base, on an image side of the media, and a polymeric barrier layer on the raw base, on a backside of the media, wherein the polymeric barrier layer is a biaxially oriented extruded polyolefin film selected from the group consisting of polyethylene, polypropylene, polymethylpentene, polybutylene, and mixtures thereof; wherein the method encompasses projecting a stream of droplets of inkjet ink composition, via inkjet printing technique, onto said media to form the desired printed image.

15. A recording media comprising:

a raw base;

an image side of the recording media having a pigmented pre-coating layer and a non-polyolefin barrier coating on the raw base; and a backside of the recording media having a polymeric barrier layer on the raw base, wherein the polymeric barrier layer is an extruded modified polypropylene copolymer polyolefin film or an extruded modified polyethylene copolymer polyolefin film, either of these copolymer polyolefin films being modified with functional co-monomer repeating units, wherein the functional co-monomer repeating units are selected from the group consisting of vinyl acetate, ethyl methyl acrylate, ethylene ethyl acrylate, ethyl acrylic acid, ethyl glycidyl methacrylate, ethyl-n-butyl acrylate, maleic anhydride, acrylic acid modified polypropylene, acrylic acid modified polyethylene, and combinations thereof.

16. The recording media according to claim 15 wherein the functional co-monomer repeating units are less than 10 wt % of the extruded modified polypropylene copolymer polyolefin film or the extruded modified polyethylene copolymer polyolefin film.

* * * * *